United States Patent [19]

Speet et al.

[11] Patent Number: 4,754,364

[45] Date of Patent: Jun. 28, 1988

[54] STATIC DISSIPATIVE CHAIR

[75] Inventors: Larry A. Speet, Holland; Alex Berman, Kentwood, both of Mich.

[73] Assignee: Steelcase Inc., Grand Rapids, Mich.

[21] Appl. No.: 74,726

[22] Filed: Jul. 17, 1987

Related U.S. Application Data

[63] Continuation of Ser. No. 785,063, Oct. 4, 1985, abandoned.

[51] Int. Cl.[4] ..... H05F 3/00

[52] U.S. Cl. ..... 361/212; 297/452; 361/220

[58] Field of Search ..... 361/212, 220; 297/463, 297/345, 452

[56] References Cited

U.S. PATENT DOCUMENTS

| | | | |
|---|---|---|---|
| 619,896 | 2/1899 | Lee | 361/221 X |
| 1,744,004 | 1/1930 | Hunt | 361/217 |
| 1,920,889 | 8/1933 | Pullen | 361/220 |
| 2,302,003 | 11/1942 | Cadwell et al. | 175/264 |
| 2,714,181 | 7/1955 | Azbill | 361/220 X |
| 2,751,523 | 1/1953 | Adams | 361/220 X |
| 2,753,491 | 7/1956 | Legge | 361/219 |
| 2,786,161 | 3/1957 | Lunden | 361/221 X |
| 2,802,148 | 4/1953 | Allder | 361/220 X |
| 3,288,175 | 11/1966 | Valko | 139/425 |
| 4,513,347 | 4/1985 | Wilcox et al. | 361/212 |
| 4,577,256 | 3/1986 | Breidegam | 361/220 |
| 4,586,106 | 4/1986 | Frazier et al. | 361/220 |
| 4,625,257 | 11/1986 | Lissner | 361/212 |
| 4,630,867 | 12/1986 | Gulliver | 361/212 X |

FOREIGN PATENT DOCUMENTS

| | | |
|---|---|---|
| 2547390 | 5/1977 | Fed. Rep. of Germany . |
| 55-63931 | 5/1980 | Japan . |

OTHER PUBLICATIONS

Brochure entitled "Discovery ESD Electro-Static Dissipative" by Fixtures Furniture (undated).

Catalog page regarding Facit Posture Chair Series (undated).

Brochure entitled "Compu-Chair Anti-Static Workstation Chair" by United Technical Products, Inc. (undated).

Article entitled "Seat-Cover Shock Eliminated" from *Mechanics* (undated).

Article entitled "Clean Room Seating Won't Release Dust" regarding by Cramer Inc. (undated).

*Primary Examiner*—L. T. Hix

*Assistant Examiner*—Brian W. Brown

*Attorney, Agent, or Firm*—Price, Heneveld, Cooper, DeWitt & Litton

[57] ABSTRACT

The specification discloses a static dissipative chair providing an electrically grounded path of controlled resistance between the upholstery fabric and the floor. The upholstery fabric has an electrical resistivity in the range of $10^5$ ohms per square to $10^9$ ohms per square to provide the controlled resistance in the grounded path.

10 Claims, 1 Drawing Sheet

STATIC DISSIPATIVE CHAIR

This is a continuation of application Ser. No. 785,063, filed Oct. 4, 1985, now abandoned.

BACKGROUND OF THE INVENTION

The present invention relates to chairs, and more particularly to chairs capable of dissipating static charges on the chair occupant to the floor.

A wide variety of seating applications require a conductive path between the chair seat and the floor to dissipate static charges which may be carried by the chair occupant. The earliest requirement for such seating known to Applicants was in surgical operating rooms wherein static discharge sparks could ignite ether and other anesthetics commonly used in the early 1960's. Subsequent requirements included electronic component assembly wherein static charges from the worker can have disastrous effects on the parts being assembled. The likelihood of such damage has increased significantly in recent times with the advent of highly sensitive, relatively low voltage electrical components. A third requirement is the computer room of large main-frame computers. Today, grounded seating is desirable, if not required, in many offices with the advent of ever-more-frequent computing equipment such as personal computers.

A variety of grounded chairs has been developed over time in response to this growing need for such seating. In approximately the mid-1970's, Steelcase Inc., the assignee of the present application, provided one such "special order" chair. This chair differed from its conventional chairs by (1) replacing the conventional nonconductive nylon upholstery fabric with a wool or other natural fiber fabric and (2) installing one or more casters having conductive carbon-filled rubber wheels. The metal chair frame, including the pedestal, the column, and the chair iron, completed an electrically conductive path between the chair seat and the floor.

Others also developed grounded seating. Typically, this seating included a conductive upholstery material and conductive casters. At least one prior artisan is believed to have provided a conductive strap between the upholstery fabric and the chair iron to improve the electrical path between the seat and the floor.

As time went on, it became apparent that such seating can be "too conductive" with possible electric shock to the chair occupants. The chair occupant in a low-resistance chair can serve as a portion of a conductive grounded path through the chair. Contact with a relatively high voltage source can cause serious injury to the chair occupant. To overcome this problem, one artisan places resistors in the conductive path between the chair seat and the floor as illustrated in U.S. Pat. No. 4,513,347, issued Apr. 23, 1985, to Wilcox et al, and entitled STATIC PROTECTIVE CHAIR. This chair includes a conductive "drag line" suspended from the chair base and engaging the floor and including resistors between the base and floor. However, this drag line is not aesthetically pleasing. Further, dirt and other contaminants accumulate on the portion of the drag line engaging the floor which changes the resistivity of the conductive path. Third, the construction is undesirably complicated and expensive. Fourth, the resistors can fail, changing the resistance of the chair dramatically.

The Department of Defense has recently published specifications related to electrical properties of materials in its bulletin DOD-HUBK-263. The bulletin defines four categories depending on the surface resistance as follows:

| Category | Surface Resistance Per Square | Protection Provided |
|---|---|---|
| Insulative | $>10^{14}$ | NONE. Electrostatic voltage levels generated with these insulators can be extremely high. |
| Anti-Static | $<10^{14}>10^{9}$ | Provides protection for moderately sensitive electrostatic dissipative items from moderate electrostatic dissipative voltages; highly sensitive items from low voltages. |
| Static Dissipative | $<10^{9}>10^{5}$ | Provides protection for moderately sensitive electrostatic dissipative items from high electrostatic dissipative voltages. |
| Conductive | $<10^{5}$ | Provides protection for highly sensitive electrostatic dissipative items from high electrostatic dissipative voltages. |

Known chairs are unable to provide the defined "static dissipative" resistance in an aestehtically pleasing, simple, and relatively inexpensive construction.

SUMMARY OF THE INVENTION

The present invention overcomes the above described problems by providing a chair wherein the resistance of the ground path is provided by the upholstery fabric. More specifically, the chair is upholstered with a fabric having an electrical resistivity in the range of $10^5$ ohms per square to $10^9$ ohms per square, inclusive. A conductive path between the upholstery fabric and the floor preferably includes conductive casters to complete a dissipative path between the chair occupant and the floor.

This ingenious placement of controlled resistance in the upholstery fabric permits the resistance to be carefully regulated. Consequently, the resistance of the chair can be set to fall within, and remain within, one of the above described categories in the referenced bulletin. The present invention enables a nearly conventional chair to be electrically grounded in an aesthetically pleasing, simple, and relatively inexpensive manner. Indeed, the grounded chair of the present invention is visually no different from the previously manufactured ungrounded chair. Finally, the chair does not include resistive elements which may fail.

These and other objects, advantages, and features of the invention will be more fully understood and appreciated by reference to the detailed description of the preferred embodiment and the drawings.

DETAILED DESCRIPTION OF THE PREFERRED EMBODIMENT

Figure 1:
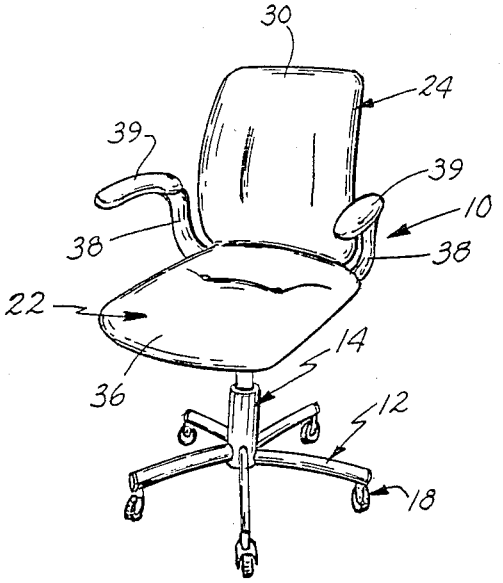
FIG. 1 is a perspective view of the chair of the present invention.
Figure 2:
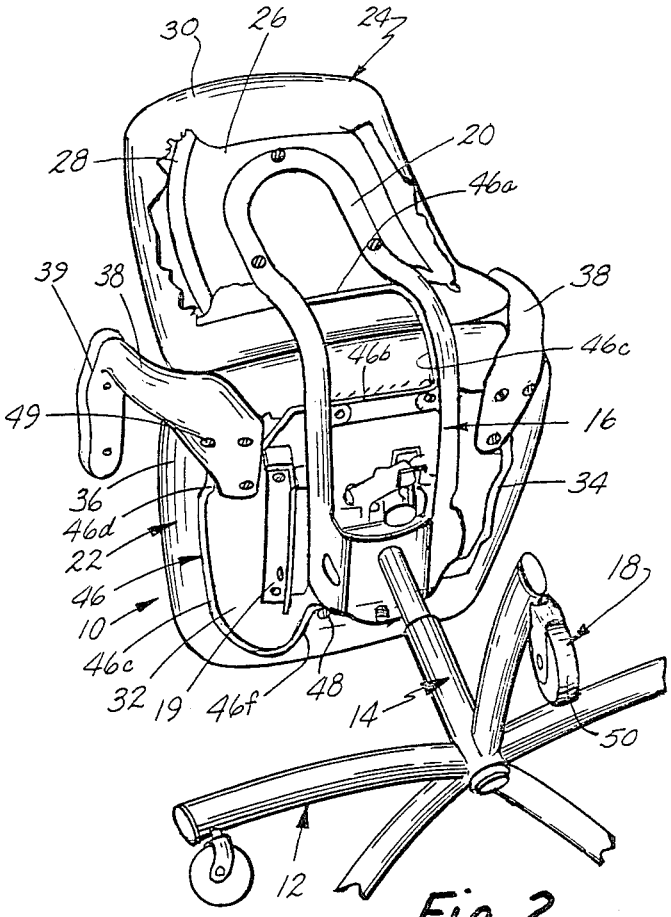
FIG. 2 is a perspective view of the underside and back of the chair with the outer chair back shell removed.

A chair constructed in accordance with a preferred embodiment of the invention is illustrated in FIGS. 1 and 2 and generally designated 10. The chair includes a base or pedestal 12, a column 14, and a control or iron 16. These elements together comprise the chair frame and are generally well known to those having ordinary skill in the art. The pedestal 12 is a five-armed pedestal including a caster 18 at the end of each arm. The column 14 in the preferred embodiment is vertically adjustable via a pneumatic or gas cylinder or a mechanical mechanism such as that sold under the mark TWISTOMATIC by Steelcase Inc., the assignee of the present invention. The control 16 can be of the type disclosed in U.S. Pat. No. 4,373,692, issued Feb. 15, 1983, to Knoblauch et al, entitled CHAIR CONTROL WITH HEIGHT ADJUSTMENT ACTUATOR, and includes a seat support 19 and a back support 20. The back support 20 is mounted for tilting or reclining movement with respect to the seat support 19.

A seat assembly 22 is supported on the seat support 19; and a back assembly 24 is supported on the back support 20. Both of the seat and back assemblies 22 and 24 are upholstered using similar constructions. The back assembly 24 includes a structural rigid inner shell 26 secured to the support 20, a foam cushion (not visible) mounted on the forward side thereof, an upholstery foam layer 28 over the foam block, and a fabric 30 draped over the foam layer 28. The foam layer 28 and the upholstery fabric 30 are wrapped about the shell 26 and stapled thereto. An outer shell or trim panel (not shown) is mounted over the back support 20 to hide the edges of the upholstery. The construction of the seat assembly 22 is generally similar to that of chair back assembly 24 with the exception that the corresponding components have different shapes and sizes. Specifically, the seat assembly 22 includes a structural inner shell 32 mounted on the control support 19, a seat cushion (not visible) positioned on the upper side thereof, a foam layer 34, and a fabric 36. Both the foam layer 34 and the fabric 36 are draped over the seat cushion and stapled to the underside of the shell 32.

Arms 38 are secured to the seat shell 32 in conventional fashion. Preferably, a steel brace (not visible) is positioned against the upper surface of the seat shell 32; and the arms are bolted to the common brace through the shell. The arms 38 are aluminum and dipped in polyvinylchloride (PVC) and each includes a PVC or fabric arm cap 39. Consequently, the arm assembly is at least somewhat conductive—perhaps in the static dissipative range.

The chair as thus far described is generally well-known to those having ordinary skill in the art. Specifically, a chair having the appearance illustrated in the drawings has long been sold by Steelcase Inc., the assignee of the present invention, under the trademark CONCENTRX as Model 454. This chair is disclosed in U.S. Pat. No. Des. 267,990, issued Feb. 22, 1983, entitled CHAIR.

Preferably, the fabrics 30 and 36 are identical to one another—both in physical properties and color. The fabric provides an electrical resistivity in the range of $10^5$ ohms per square to $10^9$ ohms per square, inclusive, to be "static dissipative" as defined in the referenced Department of Defense Bulletin DOD-HUBK-263. Preferably, the resistance of the fabric is in the range $10^6$ ohms per square to $10^8$ ohms per square, inclusive, and most preferably as close to $10^7$ ohms per square as possible. The fabric 30, 36 provides a high level of control of the dissipation of the static charge from the chair occupant. Consequently, the chair 10 does not depend upon resistors or other resistive elements in the conductive path between the chair seat and the floor.

Figure 3:
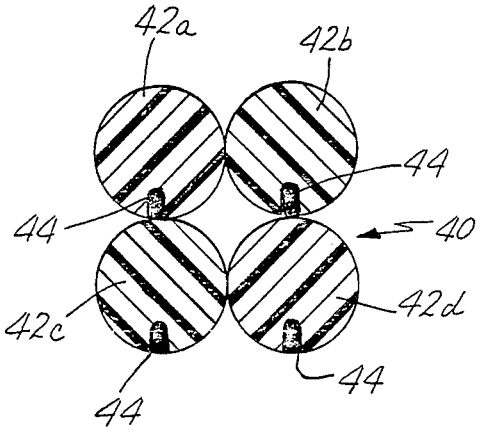
FIG. 3 is a sectional view of the conductive fiber utilized in the manufacture of the upholstery fabric yarn.

The fabric 30, 36 incorporates a conductive nylon fiber sold under the trademark NO-SHOCK by Monsanto Fibers and Intermediates Company. NO-SHOCK conductive nylon is essentially type 6,6 nylon which is 98 percent nylon and 2 percent carbon black by weight. This fiber 40 (FIG. 3) includes four identical filaments 42*a, b, c,* and *d*. The conductive carbon component comprises a small carbon "racing stripe" 44 along the longitudinal surface of the fiber. The racing stripe 44 extends the full length of the fiber and is uninterrupted. Because the stripe 44 is a portion of the surface, there is no insulative material to hamper electrostatic discharge. The carbon stripe 44 is locked into the base filament 42 to prevent dusting, cracking, and shredding. Monsanto's research indicates that this conductive nylon aids corona discharge by creating numerous conductive pathways for slow decay across the fabric into which the fiber is incorporated. Such discharge can be neither seen nor felt. To Applicants' knowledge, this NO-SHOCK conductive nylon fiber has previously been used only in carpet.

Figure 4:
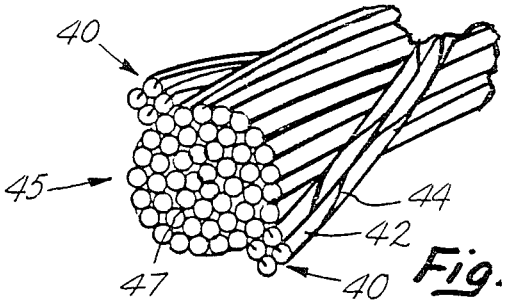
FIG. 4 is a perspective view of the upholstery fabric yarn.

The yarn 45 (FIG. 4) utilized in weaving the fabric 30, 36 is fabricated using two "effect" fibers 40 of 24-denier NO-SHOCK conductive nylon mixed with a 400-denier type 6,6 nylon core 47 in an air texturizer to produce a fuzzy yarn having a natural fiber appearance. As seen in FIG. 4, each carbon stripe 44 spirals about its filament 42; and each fiber 40 spirals about its core 47. The resultant yarn is 2 percent NO-SHOCK fiber by weight. The yarn is woven in a conventional manner by Chatham Mills to produce the resultant fabric.

A woven conductive strap 46 of tin-plated copper or a stainless steel band or other integral elongated conductor interconnects the fabrics 30 and 36, the arms 38, and the control 16. Specifically, the strap 46 includes a first portion 46*a* stapled to the chair back upholstery fabric 30 as the fabric is upholstered about the shell 26. The staples pass through the strap 46, the fabric 30, the foam layer 28, and into the shell 26. Preferably, approximately six inches of the strap 46 is stapled to the fabric using closely spaced staples to provide good electrical contact between the fabric 30 and the strap 46. The strap 46 includes a second portion 46*b* which is stapled in similar fashion to the seat fabric 36 during upholstery of the seat. Again, preferably six inches of the strap 46 is stapled to the fabric 36 using closely spaced staples to provide good electrical contact between the fabric and strap. A third portion 46*c* of the strap extends between portions 46*a* and *b* and is preferably hidden behind the chair back support 20 to be nearly invisible in the assembled chair after the outer shell or trim panel (not shown) is installed. A fourth portion 46*d* of the strap 46 is trapped between the arm 38 and the seat shell 32 to make electrical contact with the arm. Preferably, the arm 38 is not PVC-coated where it makes contact with the strap 46 to improve the electrical contact therebetween. Because both arms 38 are interconnected by a common steel brace (not visible), both arms are operatively electrically connected to the strap 46. Alternatively, the strap could be arranged to be coupled to both arms 38 between each arm and the seat shell 32. In either case, the strap 46 is wound about at least one of the attaching bolts 49 to further improve its securement. A fifth portion 46*d* of the strap 46 is also stapled to the seat fabric 36 to further improve the electrical contact between the seat fabric and the strap. Finally, the end 46*e* of the strap is electrically connected to the control 16 by a screw 48.

All of the chair frame elements are metal and therefore provide an electrically conductive path between the screw 48 and the casters 18. Specifically, the control 16, the column 14, and the pedestal 12 are all metal and make metal-to-metal contact with one another. The wheels 50 of the casters 18 are a carbon-filled synthetic and therefore are also electrically conductive. Consequently, an electrical path exists from the chair back fabric 30, chair seat fabric 36, and the arms 38 to the floor, or support surface, upon which the chair 10 rests. The resistance of the conductive path from the fabric to the floor is relatively low in comparison to the resistance provided by the fabric. This electrical path resistance is sufficiently low such that the overall resistance of the chair between the fabric and the floor is in the range $10^5$ ohms to $10^9$ ohms, inclusive. Preferably, the resistance provided by the chair is as close to $10^7$ ohms as possible.

Initial tests indicate that the present chair 10 will dissipate a 5 kilovolt static charge to a 50 volt static charge in less than 0.1 second. This provides an efficient yet safe rate of discharge, which is not felt by the chair occupant and sufficiently rapid to preclude any significant possibility of equipment damage.

The present chair 10 is a readily modified form of conventional chairs already sold in the office furniture market. Specifically, the chair differs from prior chairs only in the ingenious controlled resistance fabric 30 and 36 and the conductive strap 46. Consequently, the concepts described in conjunction with the specific chair disclosed can be incorporated into virtually any chair. Additionally, this inventive concept can be readily incorporated into other furniture items, such as upholstered office landscaping systems.

The above description is that of a preferred embodiment of the invention. Various alterations and changes can be made without departing from the spirit and broader aspects of the invention as set forth in the appended claims, which are to be interpreted in accordance with the principles of patent law, including the doctrine of equivalents.

The embodiments of the invention in which an exclusive property or privilege is claimed are defined as follows:

1. A statically dissipative chair comprising:

a frame;

a seat supported on said frame, said seat being upholstered with a fabric having electrical resistivity in the range of $10^5$ ohms per square to $10^9$ ohms per square, inclusive; and means for providing an electrically conductive path between said fabric and a support surface on which said frame rests, the resistance of said fabric and path means together in series being in the range of $10^5$ ohms to $10^9$ ohms, inclusive.

2. A chair as defined in claim 1 further comprising a back supported on said frame and upholstered with the fabric, and wherein said path means includes means for providing the conductive path also between said back fabric and the support surface.

3. A chair as defined in claim 2 wherein said path means includes an elongated conductor including a first portion connected to said back fabric, a second portion connected to said seat fabric, and a third portion connected to said frame.

4. A chair as defined in claim 3 further comprising an arm connected to a fourth portion of said elongated conductor.

5. An improved statically dissipative chair of the type including upholstery fabric and means providing an electrically conductive path between the upholstery fabric and a support surface upon which the chair is supported, said improvement comprising:

said fabric having a resistance in the range of $10^5$ ohms per square to $10^9$ ohms per square, inclusive, the total resistance of the fabric and path means in series being in the range $10^5$ ohms to $10^9$ ohms, inclusive.

6. A statically dissipative article of furniture comprising:

an exposed fabric having an electrical resistivity in the range of $10^5$ ohms per square to $10^9$ ohms per square, inclusive; and path means for providing an electrically conductive path between said fabric and a support surface upon which said furniture article is supported, the total resistance of said fabric and said path means in series being in the range $10^5$ ohms to $10^9$ ohms, inclusive.

7. A method of fabricating an article of furniture comprising the steps of:

upholstering the furniture article with a fabric having an electrical resistivity in the range of $10^5$ ohms per square to $10^9$ ohms per square, inclusive; and providing an electrically conductive path between the fabric and a support surface on which the article is to be supported, said providing step including establishing the electrical resistance of the conductive path so that the total resistance of the fabric and path in series is in the range $10^5$ ohms to $10^9$ ohms, inclusive.

8. A method as defined in claim 7 wherein the article of furniture comprises a chair, and further wherein the upholstering step includes upholstering the chair seat.

9. A method as defined in claim 8 further comprising upholstering the chair back with the fabric, and wherein said providing step includes connecting first, second, and third portions of an elongated conductor to the back fabric, seat fabric, and the chair frame, respectively.

10. A method as defined in claim 9 wherein said providing step further includes connecting a fourth portion of the elongated conductor to an arm of the chair.

* * * * *